US006643846B2

(12) United States Patent
Turner-Antonsen

(10) Patent No.: US 6,643,846 B2
(45) Date of Patent: Nov. 11, 2003

(54) DISPOSABLE GLOVES FOR PUMPING GAS

(75) Inventor: Kitty Turner-Antonsen, Albuquerque, NM (US)

(73) Assignee: Kitty Turner - Antonsen of kta enterprises, inc.

( * ) Notice: Subject to any disclaimer, the term of this patent is extended or adjusted under 35 U.S.C. 154(b) by 0 days.

(21) Appl. No.: 10/245,493

(22) Filed: Sep. 18, 2002

(65) Prior Publication Data

US 2003/0056277 A1 Mar. 27, 2003

Related U.S. Application Data

(60) Provisional application No. 60/323,092, filed on Sep. 19, 2001.

(51) Int. Cl.[7] ..... A41D 19/00
(52) U.S. Cl. ..... 2/161.6; 2/159
(58) Field of Search ..... 2/16, 20, 161, 2/161.6, 161.7, 164, 167; 15/227; 221/5, 278; 224/933

(56) References Cited

U.S. PATENT DOCUMENTS

| | | | | |
|---|---|---|---|---|
| 4,004,691 A | | 1/1977 | Wihksne | |
| D255,179 S | | 6/1980 | Peters | |
| 4,214,321 A | | 7/1980 | Nuwayser | |
| 4,240,157 A | * | 12/1980 | Peters | 2/161.6 |
| 4,645,251 A | * | 2/1987 | Jacobs | 294/1.3 |
| 4,745,635 A | | 5/1988 | Kinnear | |
| 4,791,682 A | | 12/1988 | Herr et al. | |
| 4,918,755 A | | 4/1990 | Kinnear | |
| 5,020,160 A | | 6/1991 | Cano | |
| 5,025,503 A | * | 6/1991 | O'Brien | 2/163 |
| D344,369 S | | 2/1994 | Brown | |
| 5,365,608 A | | 11/1994 | Flick | |
| 5,467,481 A | | 11/1995 | Srivastava | |
| 5,524,294 A | | 6/1996 | Richardson et al. | |
| 5,598,582 A | * | 2/1997 | Andrews et al. | 408/30 |
| 5,921,434 A | | 7/1999 | Hollander et al. | |
| 5,934,462 A | | 8/1999 | Gregory | |
| 5,966,741 A | | 10/1999 | Klecina | |
| 6,021,919 A | * | 2/2000 | Kelly | 221/25 |

FOREIGN PATENT DOCUMENTS

| | | |
|---|---|---|
| GB | 765805 | 1/1957 |
| GB | 2 208 348 A | 3/1989 |

* cited by examiner

*Primary Examiner*—John J. Calvert
*Assistant Examiner*—Katherine Moran
(74) *Attorney, Agent, or Firm*—Litman Law Offices, Ltd.; Don Watkins; Wally Kubitz

(57) ABSTRACT

A glove is provided for motorists to use when pumping gasoline at self-service stations. The glove is fabricated from light-weight, gasoline-impermeable material and is designed to be worn on either hand. The glove is made in many colors and is scented to compliment each color.

3 Claims, 3 Drawing Sheets

DISPOSABLE GLOVES FOR PUMPING GAS

CROSS-REFERENCE TO RELATED APPLICATION

This application claims the benefit of U.S. Provisional Patent Application Serial No. 60/323,092, filed Sep. 19, 2001.

BACKGROUND OF THE INVENTION

1. Field of the Invention

The present invention generally relates to protective wearing apparel. More specifically, the instant invention is drawn to a glove adapted for use by motor vehicle operators when pumping gasoline at self-service stations.

2. Description of Related Art

The self-service gasoline station has become a permanent fixture in today's rush-rush world. In fact, it is safe to assume (in the U.S.A.) that almost every motorist pumps her/his gasoline at one time or another. This scenario can present problems for the individual motorist in that dirt, grime, potentially hazardous substances and/or various forms of transmittable bacteria present on the gasoline nozzle can be easily transferred to the hands of the motorist. The most vexing problem however, appears to be that gasoline from the nozzle gets on the user's hands creating an offensive odor which lasts for a considerable time and is difficult to wash off.

The prior art is replete with patents which disclose gloves adapted to be used when pumping gasoline. This concept is shown, by way of example, in U.S. Pat. No. Des. 255,179 (Peters), U.S. Pat. No. Des. 344,369 (Brown), U.S. Pat. No. 4,240,157 (Peters), U.S. Pat. No. 4,745,635 (Kinnear), U.S. Pat. No. 4,791,682 (Herr et al.), U.S. Pat. No. 4,918,755 (Kinnear) and U.S. Pat. No. 5,020,160 (Cano).

Protective gloves adapted for use in industrial environments are shown in U.S. Pat. No. 4,214,321 (Nuwayser) and British Patent number 765,805.

U.S. Pat. Nos. 5,365,608 (Flick), U.S. Pat. No. 5,467,481 (Srivastava) and U.S. Pat. No. 5,524,294 (Richardson et al.) disclose protective gloves for use in medical laboratories.

Packaging arrangements for disposable gloves are shown in U.S. Pat. No. 4,004,691 (Wihksne), U.S. Pat. No. 5,921,434 (Hollander et al.), U.S. Pat. No. 5,934,462 (Gregory) and U.S. Pat. No. 5,966,741 (Klecina).

British Patent number 2,208,348 discloses the concept of inscribing a logo on protective apparel.

None of the above inventions and patents, taken either singly or in combination, is seen to disclose an aesthetic, pleasantly scented, protective glove as will be subsequently described and claimed in the instant invention.

SUMMARY OF THE INVENTION

The instant invention is a light-weight, disposable glove utilized to protect a motorist's hand when he/she is pumping gasoline. The glove is designed so that it may be worn on either hand. A quantity of gloves (12–24) are packaged in a durable, flexible, plastic package, which box can conveniently be stored in the glove, side door or center storage compartment of a motor vehicle, thus offering weeks of usage for the motorist. The gloves will be manufactured in a variety of sizes (small, medium, large) to accommodate the different hand sizes of motorist. The package is designed to maintain its form whether sat on, folded, condensed or pressed into tight-fitting storage areas. The gloves will also be manufactured in various colors and will emit a scent complimentary to the respective color. The inventor is mindful that in the aftermath of September 11, there are realistic threats of mass exposure to harmful bacteria and viruses such as anthrax and the like. The present invention is designed to protect against such exposure offering a premium of pump hygiene to the consumer.

Accordingly, it is a principal object of the invention to provide a protective glove to be used when pumping gasoline, which glove is effective to prevent the wearer's hand from becoming fouled with gasoline odors.

It is another object of the invention to provide a protective glove to be used when pumping gasoline, which glove is effective to prevent the transfer of hazardous substances and/or various forms of transmittable bacteria that may be present on the pumping nozzle.

It is a further object of the invention to provide a protective glove to be used when pumping gasoline, which glove is effective to prevent dirt and grime from contacting the wearer's hand, promoting hygiene usage.

Still another object of the invention is to provide a protective glove to be used when pumping gasoline, which glove is aesthetically appealing and pleasantly scented.

It is an object of the invention to provide improved elements and arrangements thereof in an apparatus for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
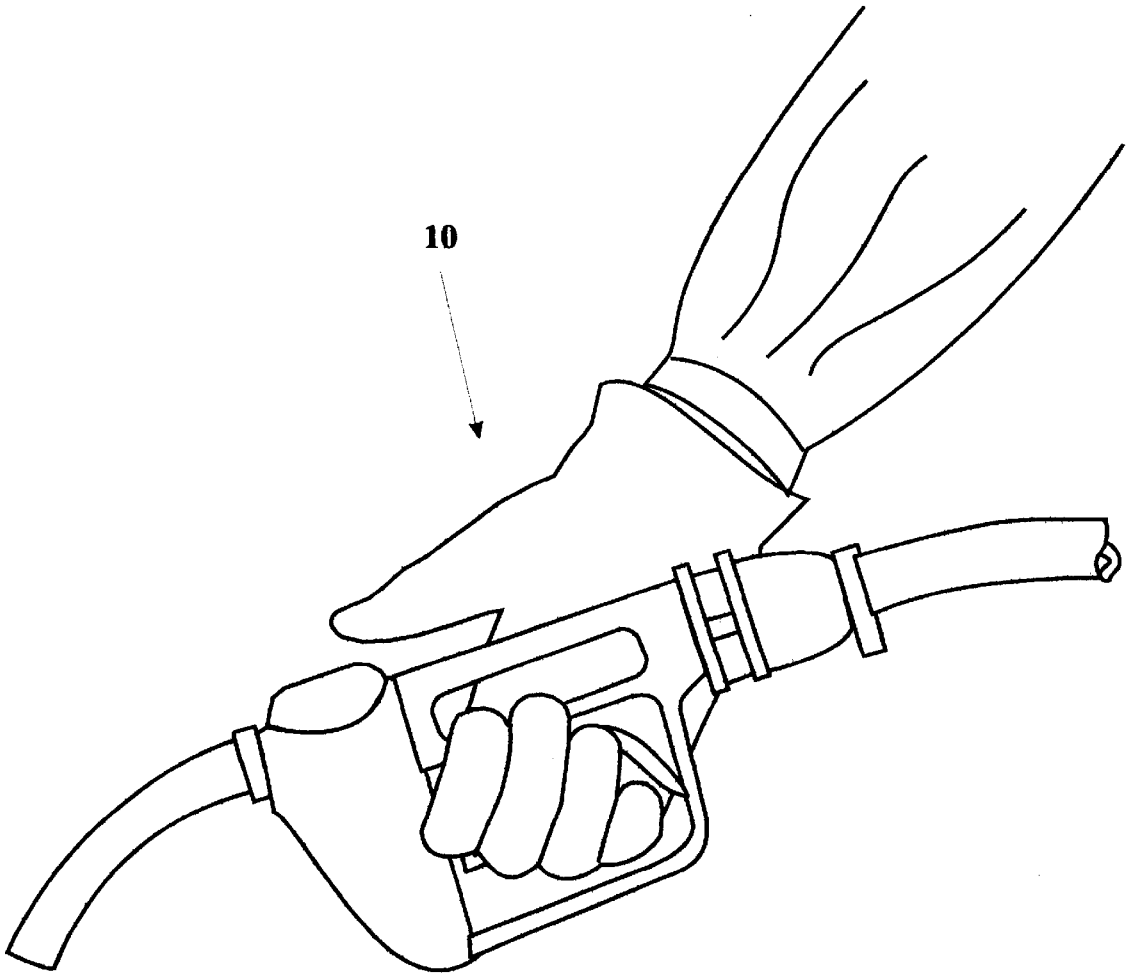
FIG. 1 is an environmental, perspective view of a disposable glove for pumping gasoline according to the present invention.
Figure 2:
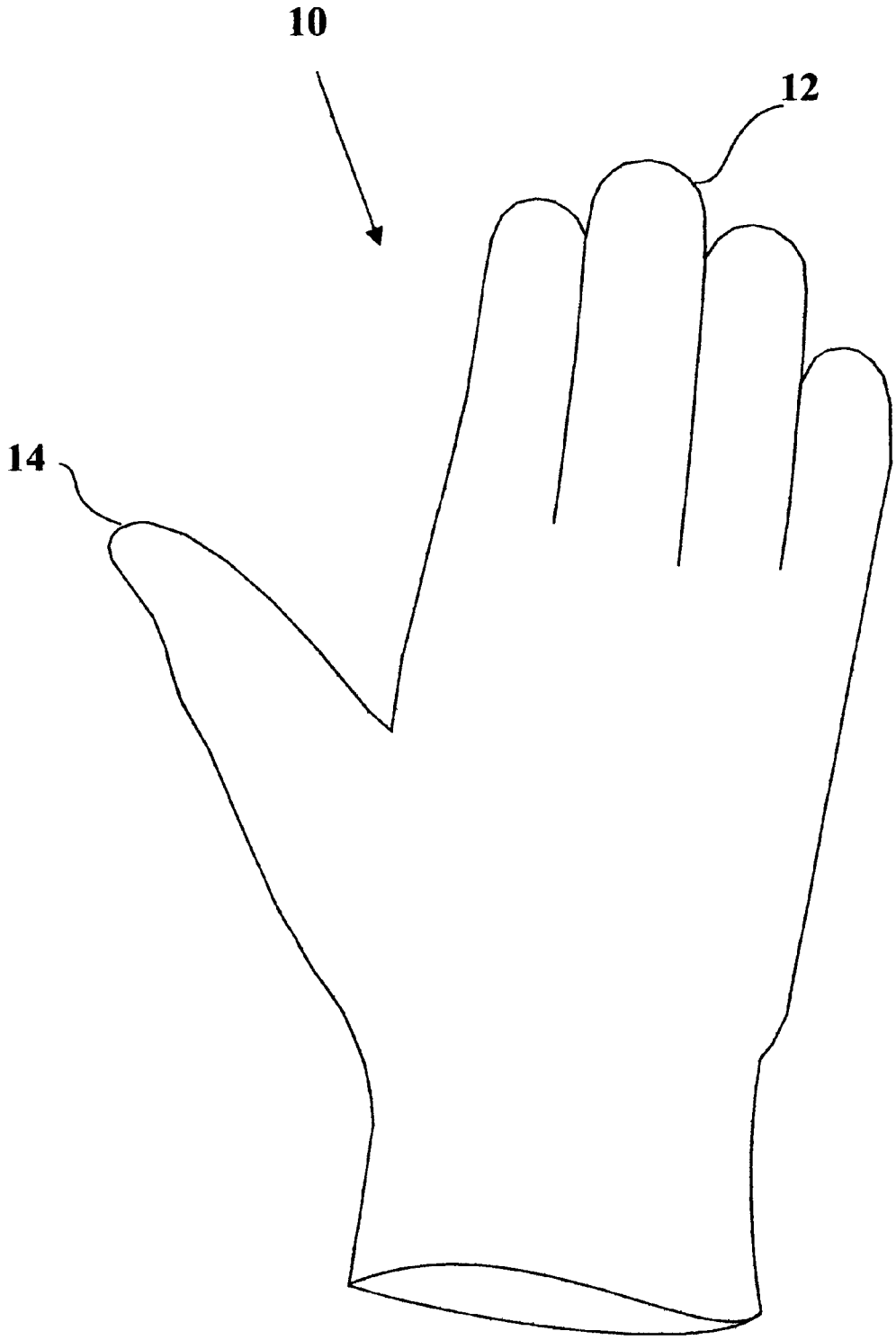
FIG. 2 is a plan view of a disposable glove for pumping gasoline according to the present invention.

Referring to FIGS. 1 and 2 of the drawings, the glove of the instant invention is indicated generally at 10. Glove 10 is fabricated from a light-weight, liquid-impermeable material. The planar design of the glove's fingers 12 and thumb 14 permits the glove to be worn on either hand. As noted above, glove 10 can be made in many colors (rose, orange, yellow, etc.) so as to satisfy different aesthetic tastes. The material of the glove can also be impregnated with pleasant scents (rose, orange, citrus, etc.) to complement the respective color. Thus, a consumer will be able to choose gloves that appeal to his/her personality.

Figure 3:
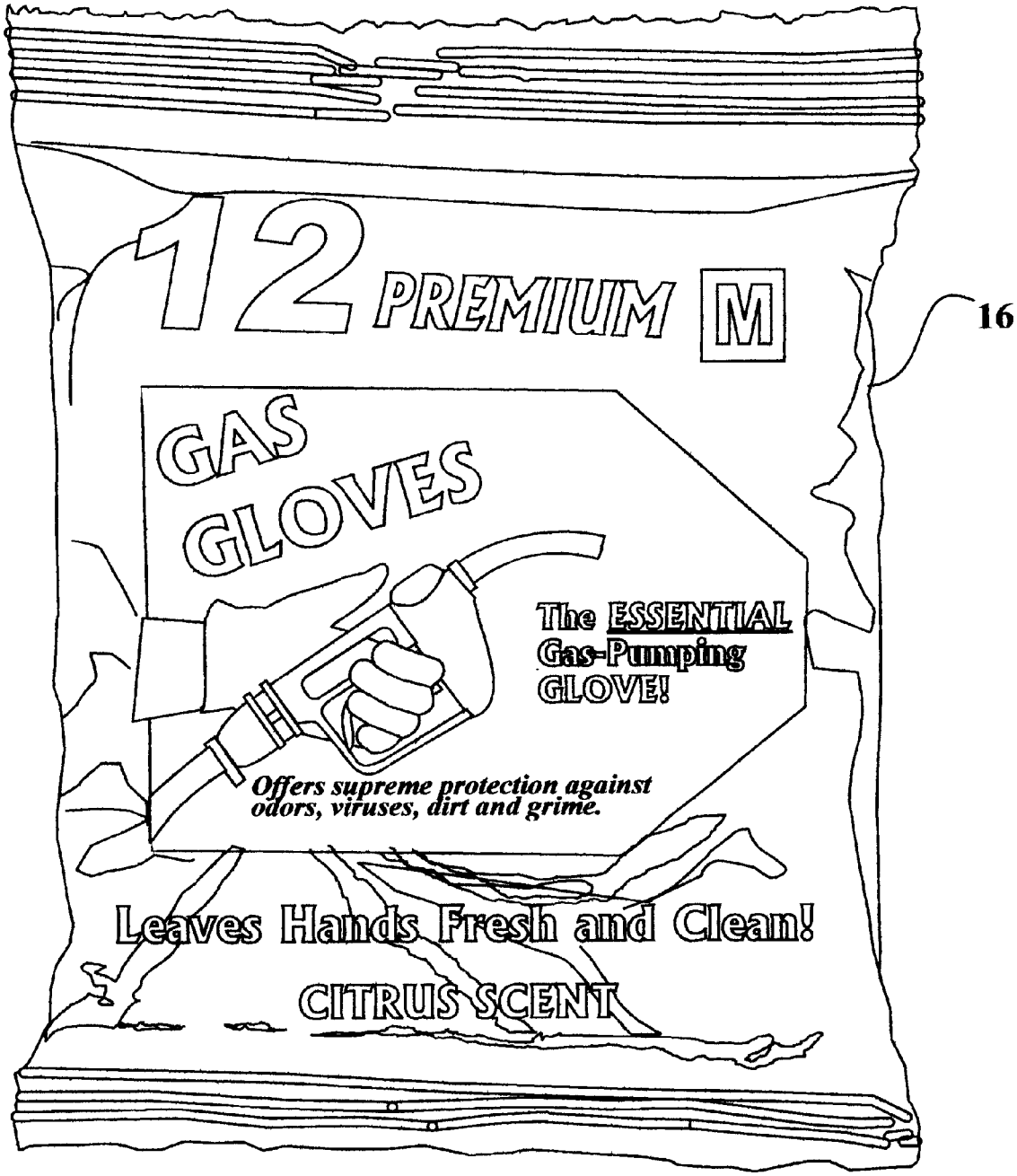
FIG. 3 is a perspective view of a package of disposable gloves for pumping gasoline according to the present invention.

Attention is now directed to FIG. 3 which shows a plurality Of gloves 10 housed in a plastic package 16 for individual dispensing when needed. Package 16 is sized so that it will easily fit inside the glove, center or side compartment of most motor vehicles. This will assure that the gloves will be readily available when there is a need to "gas up". As contemplated, package 16 can have a color and be impregnated with a scent that matches the color and scent of the gloves packaged inside thus, allowing the consumer to easily select his/her favorite color and scent. The gloves may readily be disposed of after use.

It is to be understood that the present invention is not limited to the sole embodiment described above, but encompasses any and all embodiments within the scope of the following claims.

I claim:

1. A package of gloves for use when dispensing gasoline from a self-service pump, consisting of:

a plurality of disposable gloves, each of said gloves having a unitary body fabricated from a single layer of gasoline impermeable plastic material, said body having a planar front face, a planar rear face, a palm section, four fingers and a thumb;

an artificial scent creating material impregnated in said unitary body;

a plastic package for housing said plurality of gloves, wherein said artificial scent creating material is impregnated in said plastic package and said plurality of gloves and said package are color coordinated.

2. The package of gloves for use when dispensing gasoline from a self-service pump as recited in claim 1, wherein said artificial scent creating material impregnated in said unitary body and said package is a citrus scent material.

3. The package of gloves for use when dispensing gasoline from a self-service pump as recited in claim 2, wherein said citrus scent material is that of an orange.

* * * * *